US011939826B2

(12) United States Patent
Fanguy et al.

(10) Patent No.: US 11,939,826 B2
(45) Date of Patent: Mar. 26, 2024

(54) WELLBORE ADAPTER ASSEMBLY

(71) Applicants: Robert Fanguy, Broussard, LA (US); Thomas Fanguy, Houma, LA (US)

(72) Inventors: Robert Fanguy, Broussard, LA (US); Thomas Fanguy, Houma, LA (US)

( * ) Notice: Subject to any disclaimer, the term of this patent is extended or adjusted under 35 U.S.C. 154(b) by 0 days.

(21) Appl. No.: 17/928,066

(22) PCT Filed: Jun. 2, 2021

(86) PCT No.: PCT/US2021/035422

§ 371 (c)(1),
(2) Date: Nov. 28, 2022

(87) PCT Pub. No.: WO2021/247683

PCT Pub. Date: Dec. 9, 2021

(65) Prior Publication Data

US 2023/0212919 A1 Jul. 6, 2023

Related U.S. Application Data

(60) Provisional application No. 63/034,122, filed on Jun. 3, 2020.

(51) Int. Cl.
*E21B 21/02* (2006.01)
*E21B 17/20* (2006.01)

(52) U.S. Cl.
CPC ..... *E21B 21/02* (2013.01); *E21B 17/20* (2013.01)

(58) Field of Classification Search
CPC ..... E21B 21/00; E21B 21/01; E21B 21/019; E21B 43/2607; E21B 33/038; E21B 33/068; E21B 33/076
See application file for complete search history.

(56) References Cited

U.S. PATENT DOCUMENTS 3,434,491 A * 3/1969 Bily ..... B63B 27/24 137/15.09
3,590,870 A * 7/1971 Ashton ..... F16L 27/0861 137/615
3,884,364 A * 5/1975 Mercier ..... E21B 19/002 414/137.5
2015/0263575 A1* 9/2015 Pace ..... H02K 1/278 175/203
2018/0313173 A1* 11/2018 McBeath ..... E21B 19/002
2018/0328157 A1* 11/2018 Bishop ..... F04B 17/06

FOREIGN PATENT DOCUMENTS

WO WO-0028826 A2 * 5/2000 ..... E21B 37/08

* cited by examiner

*Primary Examiner* — Blake Michener
*Assistant Examiner* — Yanick A Akaragwe
(74) *Attorney, Agent, or Firm* — Law Office of Jesse D. Lambert, LLC

(57) ABSTRACT

A wellhead adapter assembly is disclosed. A wellbore adapter is designed for connection to a drillstring, with a riser fluidly connected to the wellbore adapter. At least one tubular arm section is rotatably and fluidly connected to the riser. A positioning system is attached to the at least one tubular arm. The positioning system is adapted to maintain the at least one tubular arm in a desired position relative to the riser, despite relative movement between the drillstring and a floating structure such as a drilling rig.

16 Claims, 12 Drawing Sheets

WELLBORE ADAPTER ASSEMBLY

CROSS REFERENCE TO RELATED APPLICATIONS

This non-provisional patent application claims the benefit of and priority to U.S. provisional patent application Ser. 63/034,122, filed Jun. 3, 2020, for all purposes. The disclosure of that provisional patent application is incorporated herein, to the extent not inconsistent with this disclosure.

BACKGROUND—FIELD OF THE INVENTION

This invention relates to apparatus used in connection with the drilling and servicing of oil and gas wells. More specifically, this invention relates to apparatus and methods for fluidly connecting a pressurized line or lines used to carry fluids of any type (slurries, liquids, gases, or multiphase or multi-component streams) from a pump system to a tubular string, which may be referred to herein as a drillstring, which conveys such fluids downhole, particularly (but not exclusively) in offshore drilling/completion environments. In this application, the term "fluids" is used in a broad sense, to include any materials capable of being pumped down a drillstring.

In general, well bore interventions, drilling or completions involve placement of a drillstring (which may be drill pipe, high strength tubing, or any other tubular) from the surface extending down through a borehole. Well bore interventions, drilling, or completion jobs require fluids to be pumped down through the drillstring into the downhole formation at required pressures and flow rates.

In certain types of well operations, by way of example frac jobs or any other operations requiring high pressure fluids pumped downhole, a wellbore adapter is connected to the uppermost end of the drillstring. Piping carrying high pressure fluids from pressurized lines leading from a pump system is then connected to the wellbore adapter. This piping between the pressurized line and the drillstring, or wellbore adapter, generally comprises a number of lengths of pipe (by way of example only, each length being perhaps 6 to 8 feet long) connected by swivel joints or hoses to permit movement between the lengths of pipe or additional hoses, to permit flexibility. Such flexibility is needed, in part, because these pumping operations are frequently carried out on wells drilled or serviced from floating vessels, such as semi-submersible drilling rigs or drillships. Relative movement due to wave action, vessel heave, etc. between the drillstring (which may be considered as stationary) and the floating vessel (moving due to wave action) must be accounted for, hence the multiple sections of pipe joined by swivels. These sections of pipe must be robust enough to accommodate the pressure and fluid flow rate, resulting in very heavy lengths of pipe/hose sections. Prior art methods of connecting the pipe/hose sections to the wellbore adapter generally involved lifting both the pipe or hose and a member of the rig crew with hoists, perhaps 20' or more in the air above the rig floor, as a person was needed to connect the pipe/hoses to the wellbore adapter.

As can be readily understood, lifting heavy equipment and personnel this height and having them assist in making the connection to the wellbore or wellbore adapter while hanging from a hoist creates a host of safety issues, and is not the most efficient manner in which to make the connection between the pipe or hose to the drillstring or wellbore adapter.

Thus, the known apparatus and methods by which to connect pipe/hoses to a wellbore adapter and ultimately to a drillstring, particularly (but not exclusively) on a floating vessel, which may be a drilling rig, where relative movement between the pipe or hoses and the wellbore adapter and to the drillstring must be provided for, all present various issues, giving rise to a desire for an improved apparatus and method that addresses these issues.

SUMMARY OF THE INVENTION

The wellbore adapter assembly embodying the principles of the present invention comprises a tubular member, referred to herein as the riser, which fluidly connects to the wellbore or wellbore adapter, for example via a connector. When the wellbore adapter assembly is installed (that is, made up onto the drillstring), the riser extends from the connector (which may be a large distance above the rig floor, on the order of 30' or even much higher above the rig floor), downward toward the rig floor, with a lower end ending at a desired distance above the rig floor, which may be, by way of example only, from 15 feet down to 2 to 3 feet above the rig floor.

One presently preferred embodiment of the wellhead adapter assembly comprises a wellbore adapter, connector, and riser as described above. In addition, an articulated tubular arm assembly, comprising a plurality of articulated, fluidly and rotatably connected, tubular arm sections are connected to the lowermost end of the riser. The fluidly and rotatably connected tubular arm sections are connected one to the other, for example by pressure swivels, which may be balanced pressure swivels. The tubular arm sections may comprise single tubular members, or in other embodiments two parallel tubular members. Two parallel tubular members enable the use of balanced pressure swivels. A positioning system is attached to the articulated tubular arm assembly, for example connecting the riser and the first tubular arm section, and is adapted to maintain the tubular arm assembly in a desired position, for example relative to the riser or some other datum. The positioning system may comprise one or more fluid cylinders, which is broadly defined to include any form of be hydraulic/pneumatic/electric cylinder(s), extending between the riser and the first tubular arm section, which permits the multiple tubular arm sections of the articulated tubular arm assembly to be retracted (forming a relatively compact package with the remaining elements of the wellhead adapter assembly) and extended as desired. It is understood that the final tubular arm section, the end of which can be positioned at a convenient working height above the rig floor, can be connected to pressurized lines running to a pump system, without the need for personnel to be lifted to an elevated position, etc. The positioning system, namely the fluid cylinder(s), can serve as a motion compensator to account for relative movement between the rig and the drillstring. In some embodiments, the positioning system comprises a gear drive, positioned between the articulated arm(s) and the riser, to control movement of the articulated tubular arm assembly. In some embodiments, the positioning system comprises a control system which extends and contracts the fluid cylinder(s), or rotates the gear drive, in response to detected relative movement between the drillstring and a floating structure.

In one embodiment, a protective cage surrounds at least a portion of the wellbore adapter assembly.

It is to be understood that preferably, the wellbore adapter assembly and the associated elements are assembled in a shop environment, with the assembly then retracted into a compact size for transport to the rig. Then, the entire assembly can be picked up and joined to the drillstring in the wellbore, i.e. the wellbore adapter assembly typically made up into the drillstring tool joint positioned at a convenient height above the rig floor. Pressurized lines from the pump system can then be connected to the wellbore adapter assembly without personnel going up in a hoist, etc. to work in an elevated position.

DESCRIPTION OF THE PRESENTLY PREFERRED EMBODIMENT(S)

While various wellbore adapter assemblies can embody the principles of the present invention, with reference to the drawings some of the presently preferred embodiments can be described.

Figure 1:
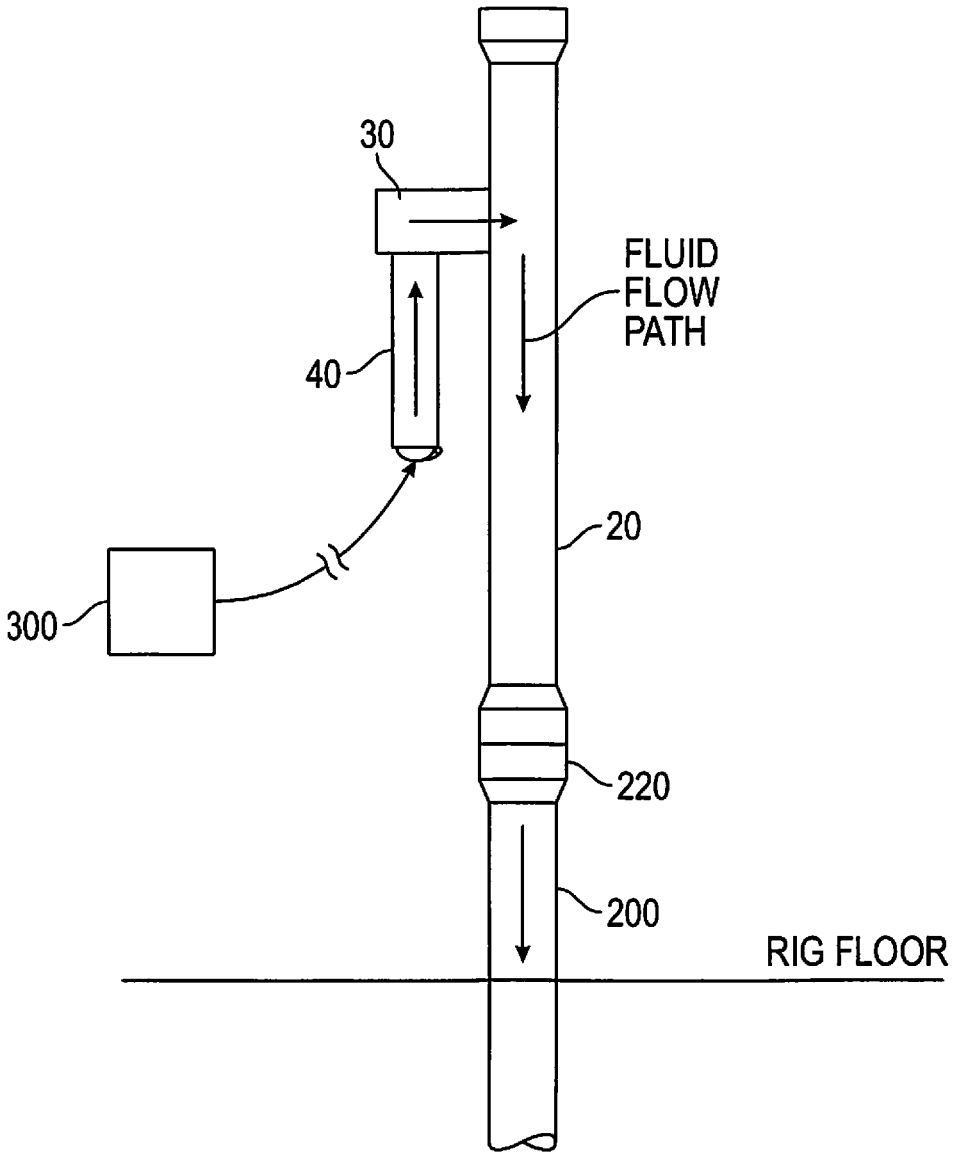
FIG. 1 is a general environmental view of a typical rig floor area, showing the drillstring positioned in the rotary of a drilling rig and the uppermost drillstring connection (tool joint) positioned above the rig floor, with the wellbore adapter stabbed into and made up with the tool joint. This drawing is to illustrate certain of the elements common to the following described embodiments.

Referring to FIGS. 1-5, this embodiment of wellbore adapter assembly 10 comprises a first tubular element or wellbore adapter 20, connector 30, and riser 40. FIG. 1 shows a general environment view of an exemplary setting. Drillstring 200 is positioned, typically in slips in the rotary, on a rig floor with an uppermost connection 220. Wellbore adapter 20 is connected to drillstring 200 by a connector, mated to uppermost connection 220, which may be a threaded connection.

As can be readily seen in FIGS. 2-5, an articulated tubular arm assembly 50, comprising a plurality of articulated tubular arm sections 52, 54 and 56, are fluidly and rotatably connected to the lowermost end of riser 40, for example by a pressure swivel 60. The tubular arm sections are fluidly and rotatably connected, also for example by pressure swivels 60. In the embodiment of FIGS. 1-5, a first tubular arm section comprises a pair of substantially parallel tubular members 52, 54 extending from riser 40. It is understood that in some embodiments only a single tubular member may be used. The final tubular arm section (that is, last in line from riser 40) is shown as element 56. It is understood that any number of tubular arm sections may be used.

Figure 2:
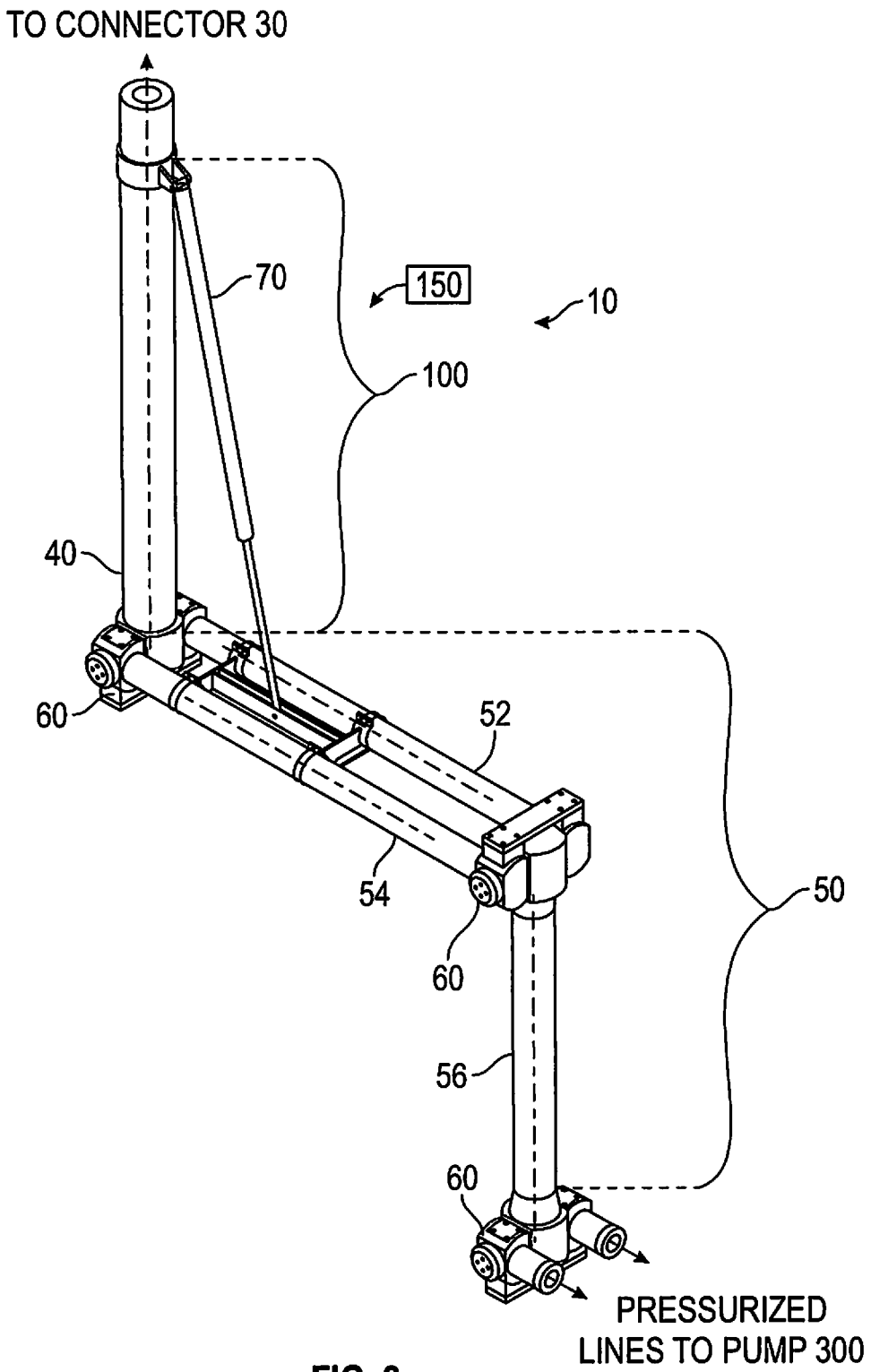
FIG. 2 is a perspective view of an embodiment of the riser and articulated tubular arm assembly and positioning system of the wellbore adapter assembly embodying the principles of the present invention, comprising multiple articulated tubular arm sections, connected to the riser.
Figure 3:
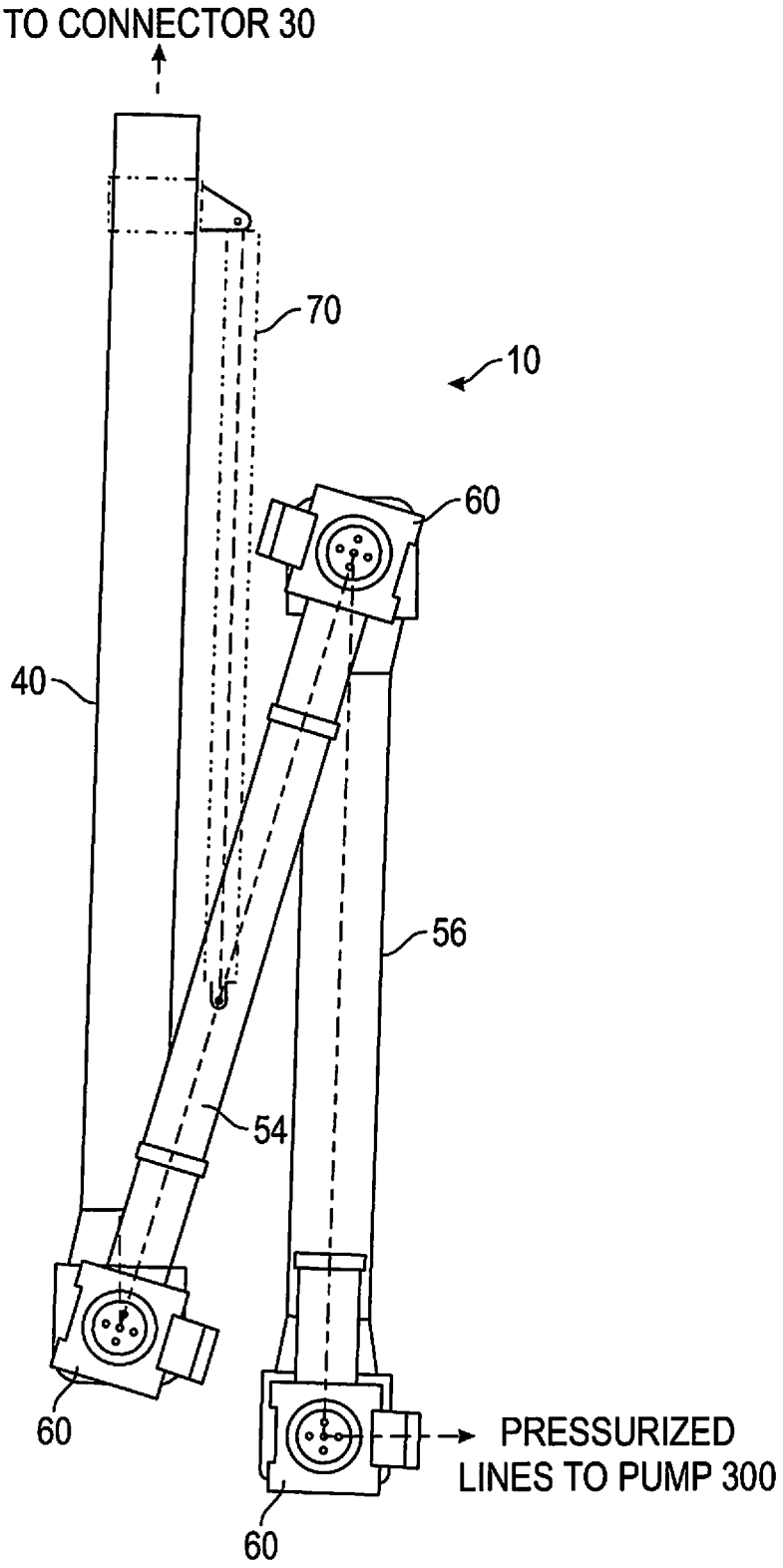
FIG. 3 shows the apparatus of FIG. 2, in a retracted position.
Figure 4:
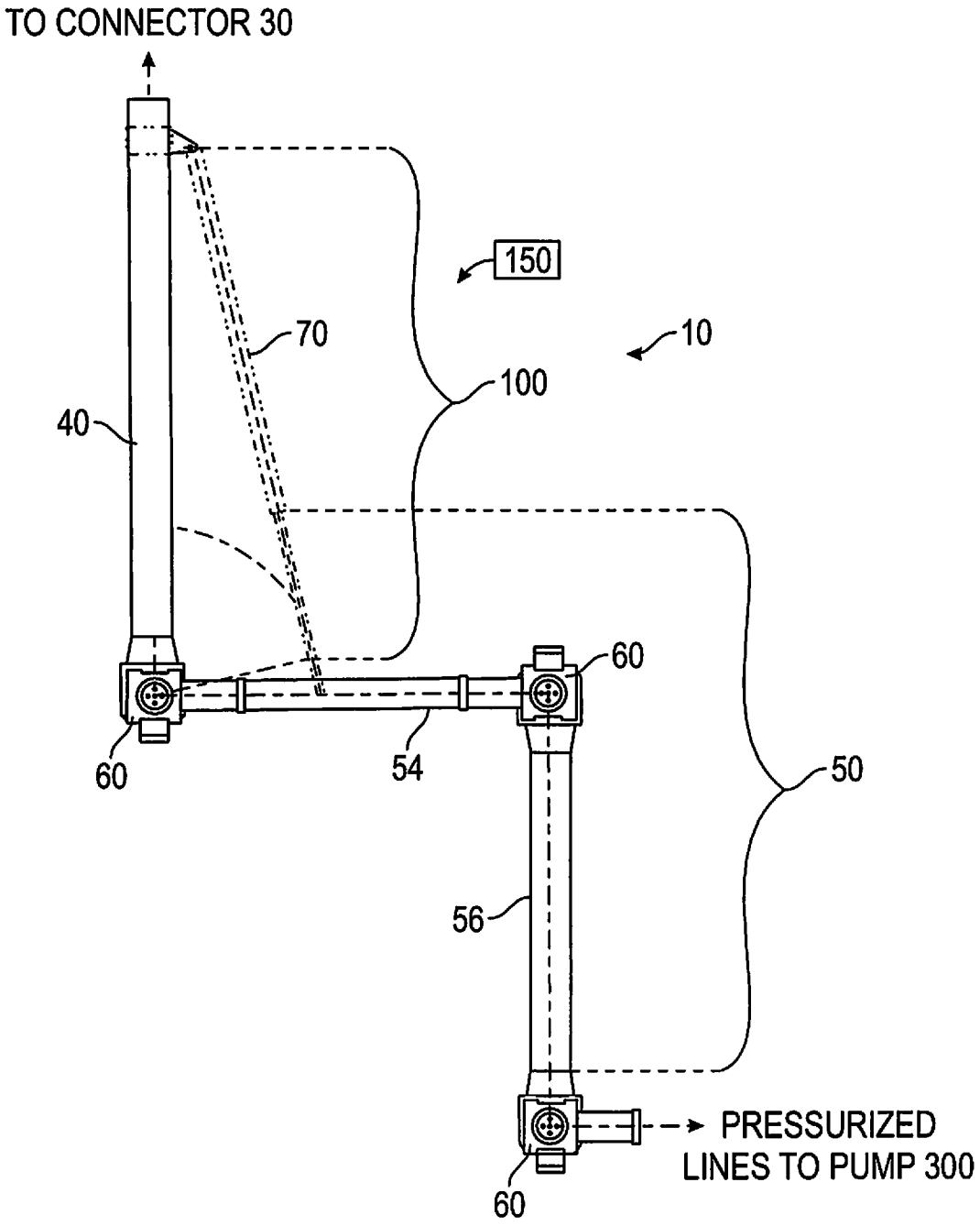
FIG. 4 shows the apparatus of FIG. 2, in a first extended position.
Figure 5:
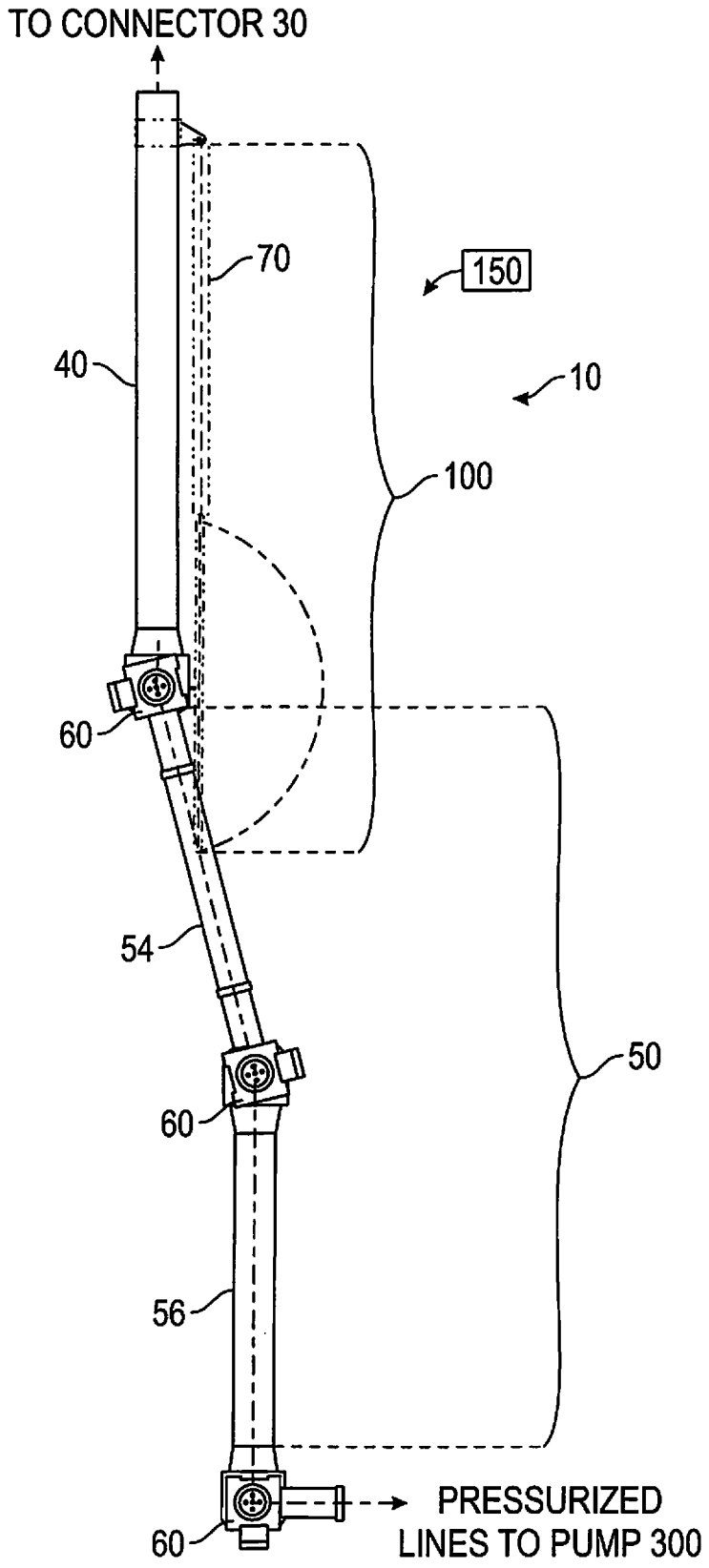
FIG. 5 shows the apparatus of FIG. 2 in a fully extended position.

Wellbore adapter assembly 10 comprises a positioning system generally denoted as 100, which in one embodiment comprises a fluid cylinder 70, which may be hydraulic, pneumatic, electric or some combination thereof, which exerts a desired force on articulated tubular arm assembly 50, and extends and retracts as required to maintain the tubular arm sections 52, 54, and 56 in a desired position, in particular relative to riser 40 (or some other desired datum). In the pictured embodiment, fluid cylinder 70 extends between riser 40 and arm sections 52, 54, which permits on articulated tubular arm assembly 50 to be retracted (forming a relatively compact package with the other elements of wellbore adapter assembly 10), as seen in FIG. 3, and extended as desired as shown in FIGS. 2, 4 and 5. It is understood that the final articulated tubular arm section 56, the end of which can be positioned at a convenient working height above the rig floor, is connected to the pressurized lines, which may be pipe or hose, without the need for personnel to be lifted to an elevated position, etc. Pump system 300 is fluidly connected to riser 40 by pressured lines and articulated tubular arm assembly 50. Fluid flowpath is shown in FIG. 1 by the arrows.

Positioning system 100, for example comprising fluid cylinder 70, can be used as a motion compensator to account for relative movement between the rig and the drillstring. It is understood that a plurality of fluid cylinders 70 may be used. In some embodiments, positioning system 100 is passive, in that fluid cylinder 70 exerts a substantially fixed force on tubular arm sections 52, 54 and 56. In other embodiments, wellbore adapter assembly 10, namely positioning system 100 comprises a control unit 150, shown in schematical form in the figures. Control unit 150 comprises sensors, detectors, electrical components, fluid pumps and controls, etc. and any other components necessary to extend and retract fluid cylinder 70 in response to detected data and information, for example relative movement between the drillstring and the floating structure, for example a drilling rig.

FIG. 2 is a perspective view of elements of wellbore adapter assembly 10, with the tubular arm sections 52, 54 and 56 in a first, partially extended position. FIG. 3 shows tubular arm sections 52, 54 and 56 in a retracted position. It is understood that wellbore adapter assembly 10 comprising the plurality of arm sections 52, 54 and 56, in this retracted position, may be assembled in a shore location, then sent to a work site in this retracted, relatively compact position, for assembly to the drillstring. Certain elements are omitted from FIG. 3 for clarity. FIG. 4 is a side view of the apparatus, in the position shown in FIG. 2. FIG. 5 shows the apparatus in a fully extended position.

Figure 6:
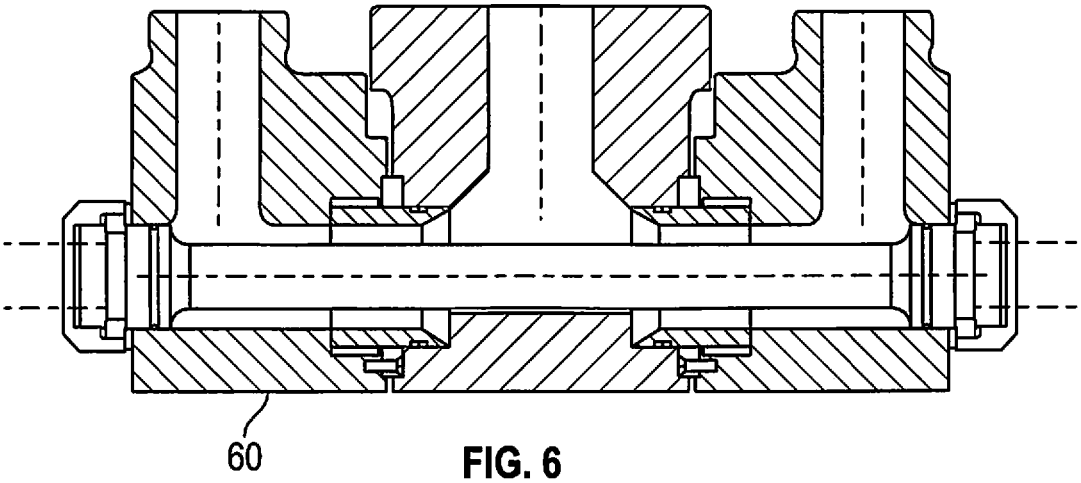
FIG. 6 is a cross section of an exemplary balanced pressure swivel, suitable for use in connection with the wellbore adapter assembly.

In certain embodiments, certain of the tubular arm sections comprise two parallel tubulars, for example arm sections 52, 54. The tubular arm sections may be connected by pressure balanced swivels or non-pressure balanced swivels. Two parallel tubulars, for example 52, 54, may be especially, although not exclusively suitable for, the use of pressure balanced swivels. FIG. 6 is a cross section view of one embodiment of a suitable pressure balanced swivel 60 (as can be seen in FIGS. 2-12B). It is understood that various designs of pressure balanced swivels may be used in the apparatus; fundamentally, pressure balanced swivels provide a means to balance forces arising from pressures within the swivel, while permitting rotation under pressure. As noted above, it is further understood that any form of swivel which fluidly and rotatably connects the tubular arm sections may be used, whether pressure balanced or non-pressure balanced.

A variation of the wellbore adapter assembly 10 is shown in FIGS. 7-10. This variation comprises a plurality of articulated arm sections, namely 52, 54, and 56, as in the previously shown variation. Preferably, the pair of arm sections 52, 54 extend from riser 40, positioned on one side of first tubular section or wellbore adapter 20; around first tubular section or wellbore adapter 20 (that is, one of the pair of parallel tubulars passing on each side of wellbore adapter 20, so that the pair of parallel tubulars 52, 54 straddle wellbore adapter 20), then the pair of parallel tubular members 53, 54 joining with a pressure balanced swivel 60 on the other side of wellbore adapter 20—namely the side opposite riser 40. Said another way, in this embodiment, wellbore adapter 20 is positioned between the pair of parallel tubulars 53, 54. Preferably, a pair of fluid cylinders 70 are provided, one attached to each of arm sections 52, 54. Pressure balanced swivels 60 are used as in the previous variation. This variation provides for a more compact arrangement of articulated tubular arm assembly 50.

Figure 7:
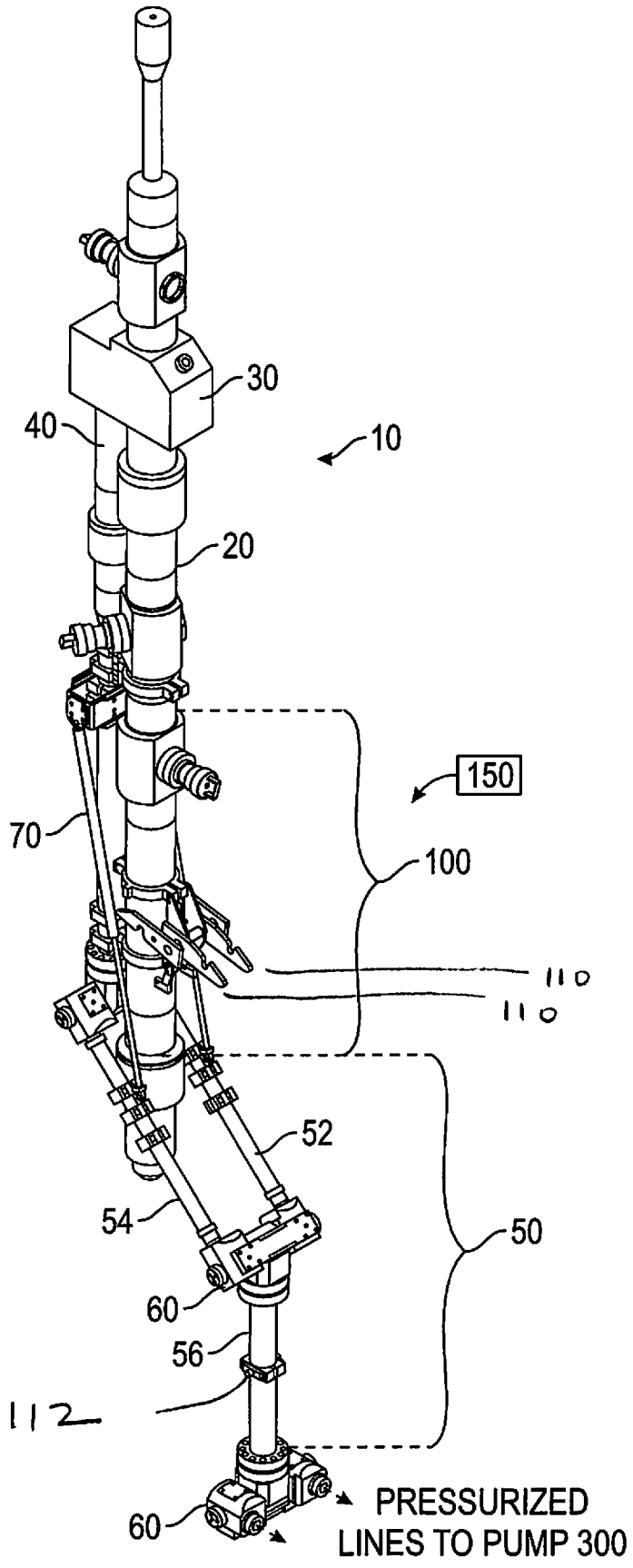
FIG. 7 is a perspective view of a variation of the wellbore adapter assembly, with the articulated tubular arm assembly in an extended position.
Figure 8:
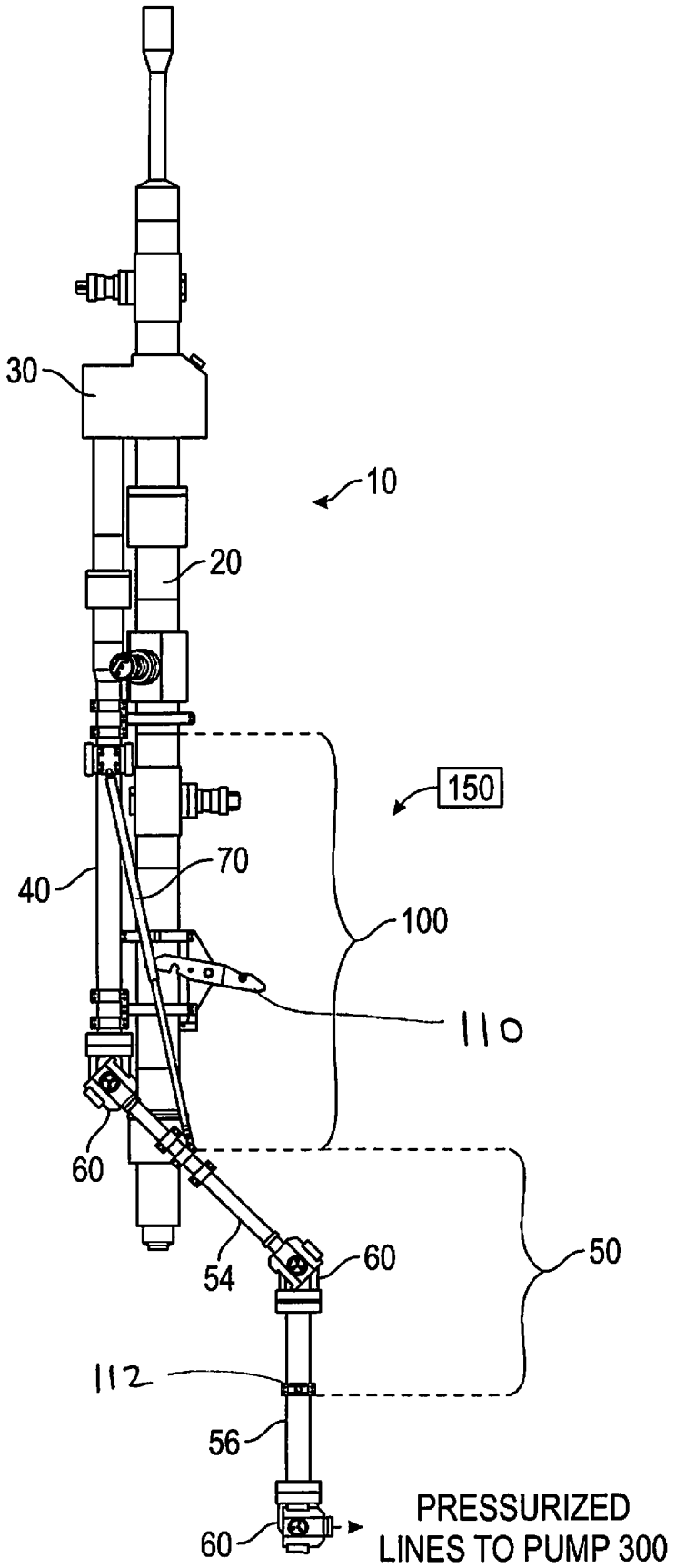
FIG. 8 is a side view of the extended position of FIG. 7.
Figure 9:
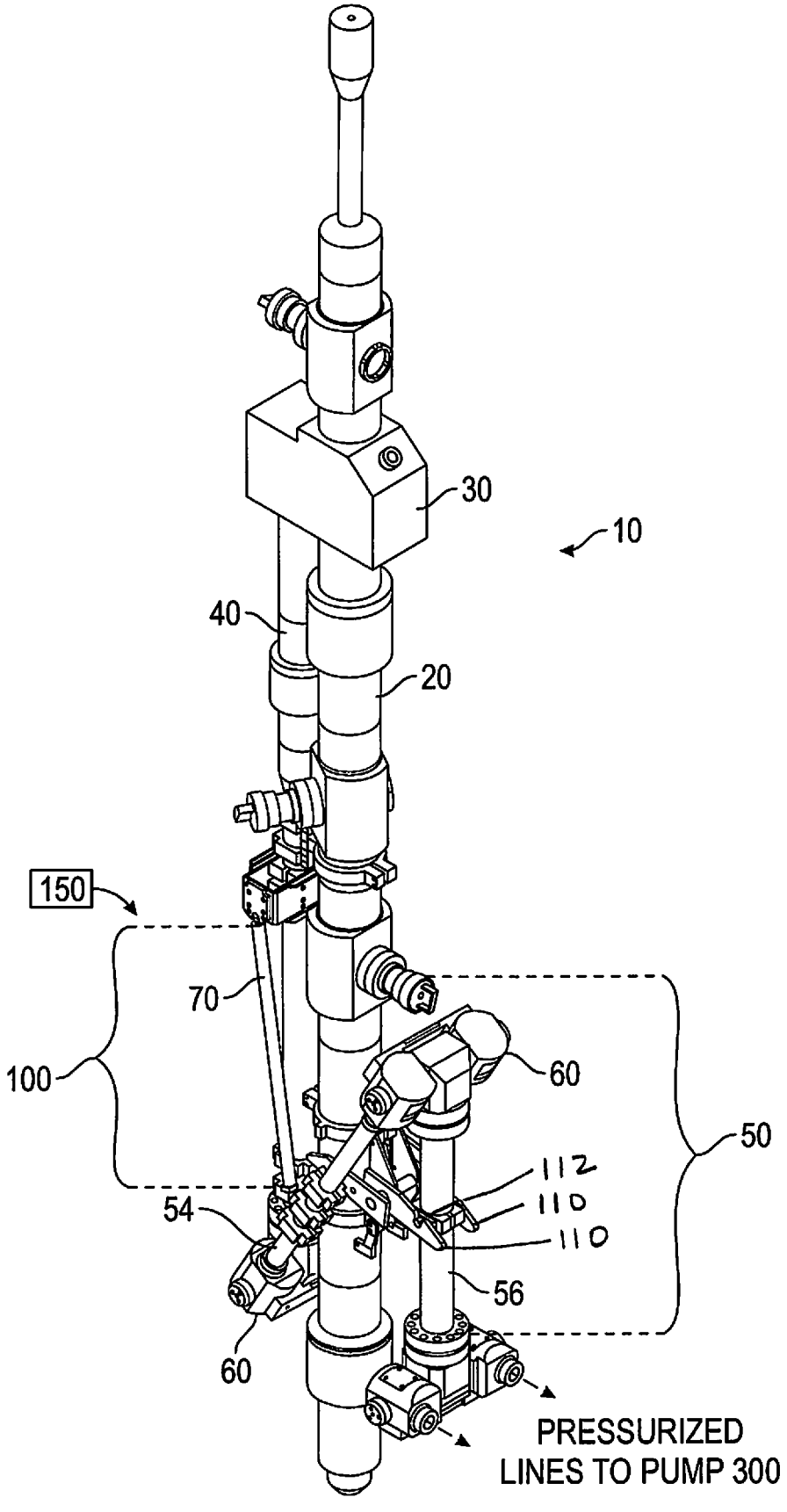
FIG. 9 is a perspective view of the variation of the assembly of FIG. 7, with the articulated tubular arm assembly in a retracted position.
Figure 10:
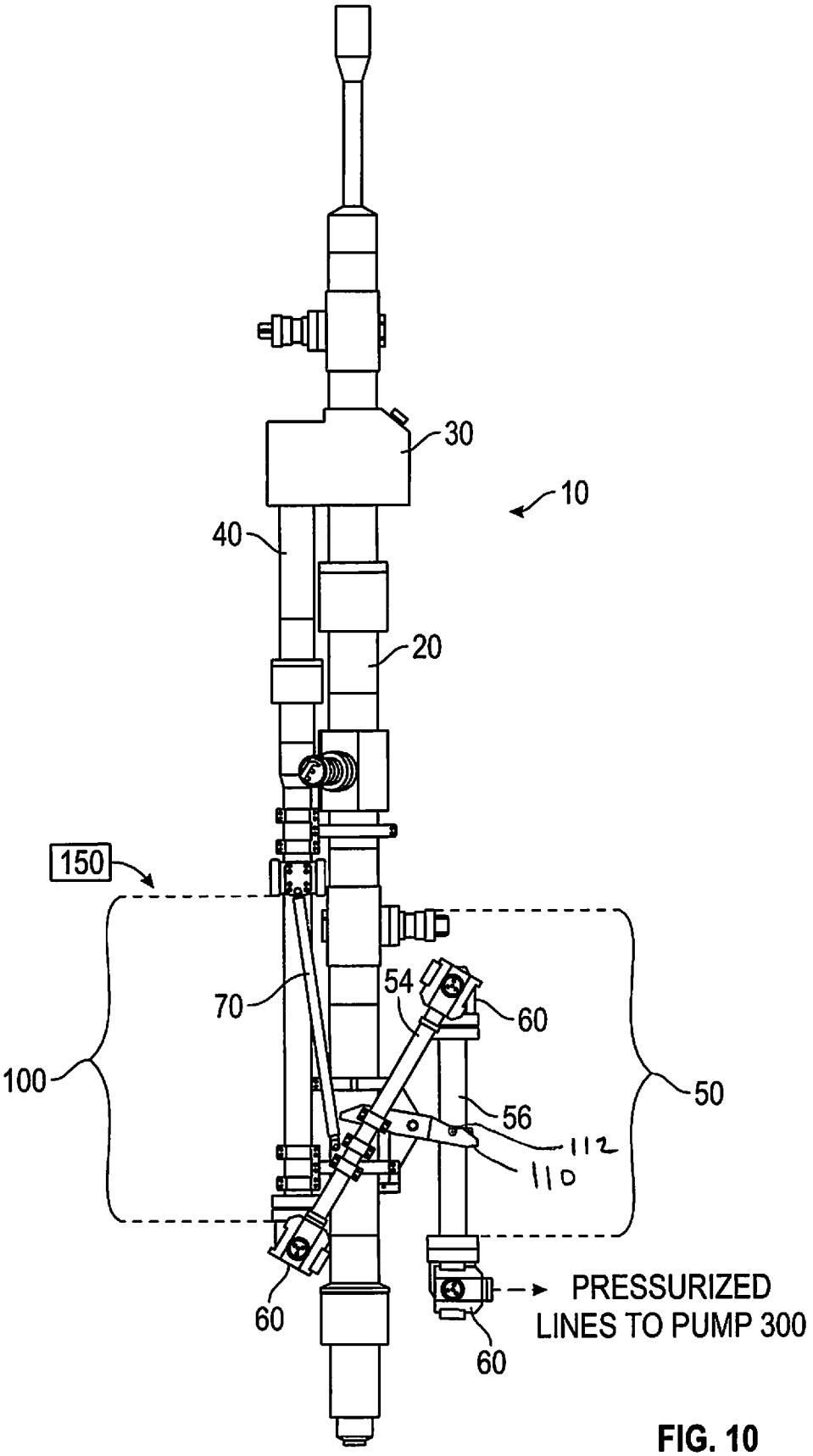
FIG. 10 is a side view of the retracted position of FIG. 9.

FIG. 7 is a perspective view of wellbore adapter assembly 10, with articulated tubular arm assembly 50 in an extended position. FIG. 8 is a side view of wellbore adapter assembly 10 in the position shown in FIG. 7. FIG. 9 is a perspective view of wellbore adapter assembly 10, with articulated tubular arm assembly 50 in a retracted position. FIG. 10 is a side view of wellbore adapter assembly 10 in the position shown in FIG. 9.

As can be seen in FIGS. 77-10, 12A and 12B, a latch may be provided to securely hold wellbore adapter assembly in a collapsed position, as shown in FIGS. 9 and 10, comprising one or more latch arms 110 which engage projections 112 on one of the tubular arm sections, for example arm sections 52 and 54.

Figure 11A:
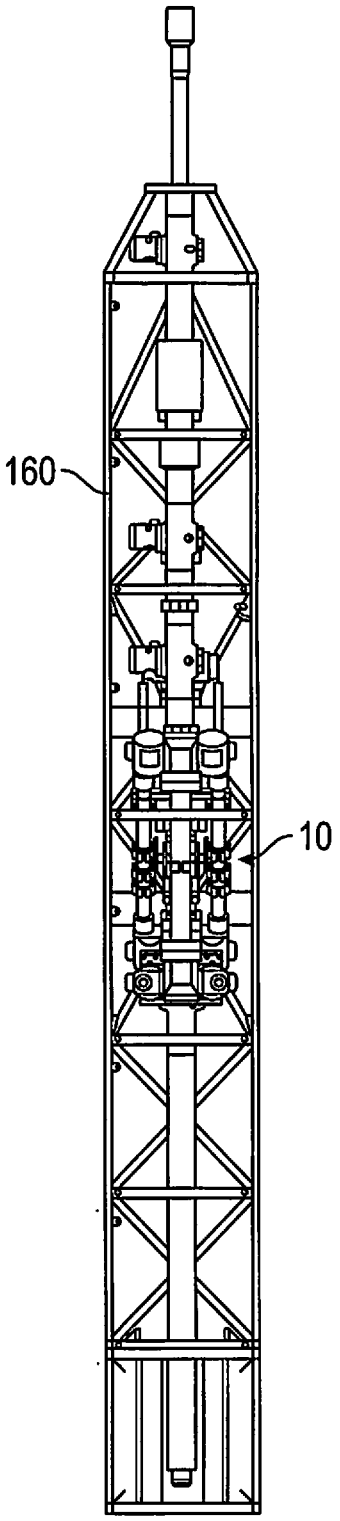
FIGS. 11A and 11B show the wellbore adapter assembly with a protective cage.
Figure 11B:
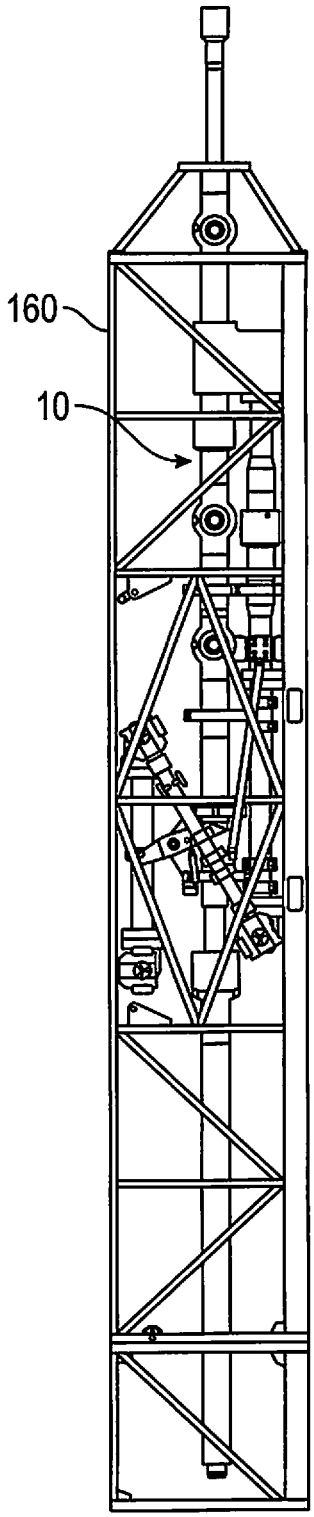

As shown in FIGS. 11A and 11B, a protective cage 160 may be provided around at least a portion of wellbore adapter assembly 10.

Figure 12A:
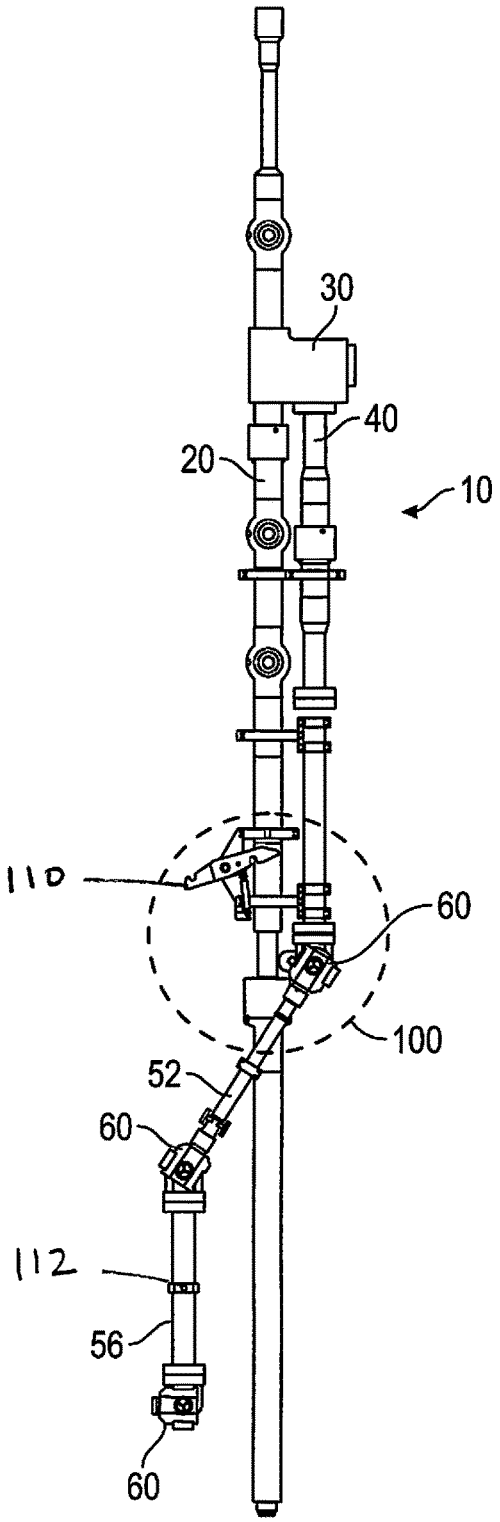
FIGS. 12A and 12B show the gear assembly embodiment of the positioning system.
Figure 12B:
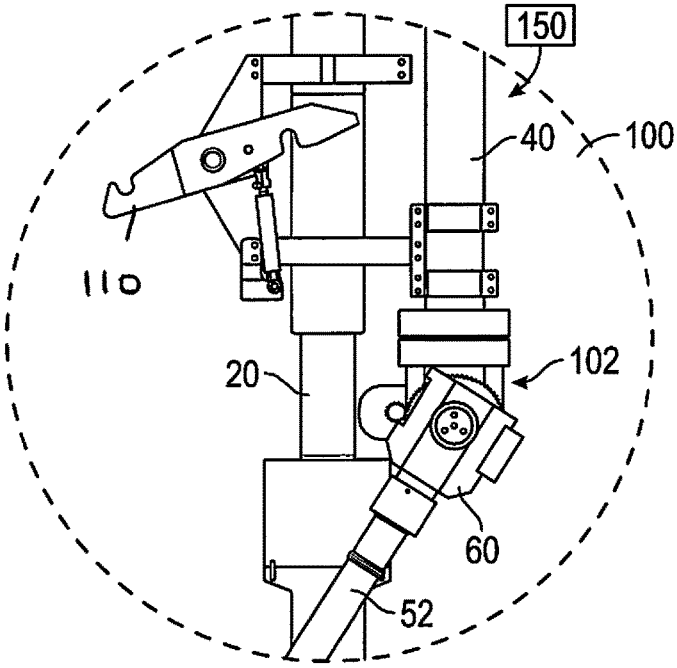

In another embodiment, FIGS. 12A and 12B, positioning system 100 comprises a gear system 102. In this embodiment, a plurality of gears are controlled by control system 150, and rotate as desired to maintain tubular arm section assembly in a desired position.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof.

Therefore, the scope of the invention is to be determined not by the illustrative examples set forth above, but by the appended claims and their legal equivalents.

We claim:

1. Apparatus, comprising:

a wellbore adapter designed for connection to a drillstring;

a riser fluidly connected to said wellbore adapter;

at least one tubular arm section rotatably and fluidly connected to said riser; and a positioning system attached to said at least one tubular arm, said positioning system adapted to maintain said at least one tubular arm in a desired position relative to said risers;

wherein said at least one tubular arm section comprises first and second tubular arm sections, wherein said first of said tubular arm sections is rotatably and fluidly connected to said riser and wherein said positioning system is operationally attached to said first tubular arm section; and wherein said second tubular arm section is rotatably and fluidly attached to said first tubular arm section;

and wherein said first tubular arm section comprises a pair of substantially parallel tubular members rotatably and fluidly connected at one end to said riser by a pressure swivel; and wherein said second tubular arm section is connected to a second end of said pair of substantially parallel tubular members by a pressure swivel.

2. The apparatus of claim 1, wherein said positioning system comprises a fluid cylinder which exerts a desired force on said at least one tubular arm, and extends and retracts as required to maintain said at least one tubular arm in said desired position relative to said riser.

3. The apparatus of claim 2, wherein said positioning system further comprises a control unit which extends and retracts said fluid cylinder in response to detected relative movement between said drillstring and a rig floor.

4. The apparatus of claim 2, wherein said fluid cylinder comprises a hydraulic cylinder.

5. The apparatus of claim 1, wherein said positioning system comprises a gear system.

6. The apparatus of claim 1, wherein said wellbore adapter is positioned between said pair of substantially parallel tubular members.

7. The apparatus of claim 6, further comprising a protective cage around at least a portion of said apparatus.

8. The apparatus of claim 1, further comprising a protective cage around at least a portion of said apparatus.

9. A wellbore adapter assembly, comprising:

a wellbore adapter designed for connection to a drillstring;

a riser fluidly connected to said wellbore adapter;

a tubular arm assembly, comprising first and second tubular arm sections, wherein said first of said tubular arm sections is rotatably and fluidly connected to said riser and said second tubular arm section is rotatably and fluidly attached to said first tubular arm section;

a positioning system operationally attached to said tubular arm assembly, said positioning system adapted to maintain said tubular arm assembly in a desired position;

wherein said first tubular arm section comprises a pair of substantially parallel tubular members rotatably and fluidly connected at a first end to said riser; and wherein said second tubular arm section is rotatably and fluidly connected to a second end of said pair of substantially parallel tubular members.

10. The wellbore adapter assembly of claim 9, wherein said positioning system comprises a fluid cylinder which exerts a desired force on said at tubular arm assembly, and extends and retracts as required to maintain said tubular arm assembly in said desired position.

11. The wellbore adapter assembly of claim 10, wherein said positioning system further comprises a control unit which extends and retracts said fluid cylinder in response to detected relative movement between said drillstring and a rig floor.

12. The wellbore adapter assembly of claim 10, wherein said positioning system further comprises a control unit which controls said gear system in response to detected relative movement between said drillstring and a rig floor.

13. The wellbore adapter assembly of claim 9, wherein said positioning system comprises a gear system.

14. The wellbore adapter assembly of claim 9, wherein said wellbore adapter is positioned between said pair of substantially parallel tubular members.

15. The wellbore adapter assembly of claim 9, further comprising a protective cage around at least a portion of the wellbore adapter assembly.

16. The wellbore adapter assembly of claim 9, further comprising one or more latch arms engageable with one or more projections on one or more of said tubular arm sections when said tubular arm assembly is in a retracted position.

* * * * *